US012091796B2

(12) United States Patent
Gupta

(10) Patent No.: US 12,091,796 B2
(45) Date of Patent: Sep. 17, 2024

(54) SEWING THIMBLE

(71) Applicant: Nikhil Gupta, Schaumburg, IL (US)

(72) Inventor: Nikhil Gupta, Schaumburg, IL (US)

( * ) Notice: Subject to any disclaimer, the term of this patent is extended or adjusted under 35 U.S.C. 154(b) by 116 days.

(21) Appl. No.: 17/818,339

(22) Filed: Aug. 8, 2022

(65) Prior Publication Data

US 2023/0060560 A1 Mar. 2, 2023

Related U.S. Application Data

(60) Provisional application No. 63/236,395, filed on Aug. 24, 2021.

(51) Int. Cl.
*D05B 91/04* (2006.01)

(52) U.S. Cl.
CPC ..... *D05B 91/04* (2013.01)

(58) Field of Classification Search
CPC ..... D05B 91/00; D05B 91/04
USPC ..... D32/29
See application file for complete search history.

(56) References Cited

U.S. PATENT DOCUMENTS 260,695 A * 7/1882 Lubin ..... D05B 91/04 223/101
353,389 A * 11/1886 Weber ..... D05B 91/04 223/101
635,369 A * 10/1899 Bowen ..... D05B 91/04 D3/29
649,310 A * 5/1900 Iles ..... D05B 91/04 D3/29
859,771 A * 7/1907 Holden ..... D05B 91/04 223/101
1,150,724 A * 8/1915 Willsey ..... D05B 91/04 223/101
1,197,388 A * 9/1916 Mullen ..... D05B 91/04 223/101
2,588,528 A * 3/1952 Howser ..... D05B 91/04 D3/29
3,722,763 A * 3/1973 Heinz ..... D05B 91/04 223/101
4,102,479 A 7/1978 Braley
4,127,222 A 11/1978 Adams
4,239,134 A 12/1980 Joy
4,643,341 A 2/1987 Hostetler
5,765,731 A 6/1998 Callian
5,803,322 A 9/1998 Boone et al.
6,726,068 B2 4/2004 Miller
7,296,715 B1 11/2007 Jerome
(Continued)

*Primary Examiner* — Ismael Izaguirre
(74) *Attorney, Agent, or Firm* — Dunlap Bennett & Ludwig, PLLC; Anna L. Kinney

(57) ABSTRACT

A thimble includes a flexible tapered sleeve and a crown. The sleeve has a frustoconical shape with a fluted sidewall. Multiple outwardly convex panels extend entirely around the sidewall. The sleeve has a mounting end opposite an opening for inserting a user's digit. The sleeve has a pitch of from 0.175 mm/mmL to 0.35 mm/mmL. The crown is formed of hard plastic material and is attached to the mounting end of the sleeve. The crown has a cap with an upper textured planar surface. A ridged sidewall extends entirely around the crown. Multiple longitudinal ridges extend from a lower edge of the sidewall to the cap. The thimble accommodates a variety of finger sizes and the crown prevents slippage of a sewing needle.

20 Claims, 6 Drawing Sheets

(56) References Cited

U.S. PATENT DOCUMENTS

| | | | | | |
|---|---|---|---|---|---|
| D611,244 | S | * | 3/2010 | Ozeki | D3/29 |
| 2020/0102679 | A1 | | 4/2020 | Gupta | |

* cited by examiner

SEWING THIMBLE

CROSS-REFERENCE TO RELATED APPLICATION

This application claims the benefit of priority of U.S. Provisional Application No. 63/236,395, filed Aug. 24, 2021, entitled Sewing Thimble, which is incorporated by reference herein in its entirety.

TECHNICAL FIELD

The present invention relates to thimbles used in connection with sewing; and in particular, to a thimble with a tapered and fluted flexible sleeve which accommodates a variety of finger sizes and has a textured hard plastic crown to prevent slippage of a sewing needle.

BACKGROUND

Thimbles used for sewing with flexible sleeves are known in the art. Braley, U.S. Pat. No. 4,102,479 discloses a thimble having a resilient frusto-conical resilient liner cooperating with a concentrically disposed resilient pad defining a circumferentially extending space adapted for use by a person having long fingernails, with the end of the finger in abutting contact with the resilient pad. The liner is formed from a soft coarse resilient material, allowing air to the enclosed finger portion while keeping the enclosed finger portion cool and dry. Optionally, the longitudinal length of the thimble may be increased by a resilient band removably gripping the bead on the end portion of the thimble opposite the end portion that is closed by the end piece.

Adams, U.S. Pat. No. 4,127,222, discloses a sewing thimble having an elongated, tubular body consisting of a pliable material, such as rubber, wherein a plurality of vent holes are disposed about the annular body portion, the inner bore thereof being designed to conform to the average finger, including those having extended fingernails. The forward head portion of the thimble is enlarged with a thickened area of a hard rubber or plastic to allow for forceful engagement with a needle to be threaded. Alternative arrangements include a protective shield embedded within the head portion and a threading-and-cutting device mounted to the thimble at the tip of the enlarged head thereof.

Joy, U.S. Pat. No. 4,239,134, discloses a flexible thimble for sewing which allows the thimble to conform to the finger for fit and comfort; providing a supple surface to allow the user to actually feel the needle; and provides a protective means located near the closed end of the thimble for covering part of the normal fingertip and fingerprint area, to protect the finger from the penetration of sharp objects.

Hostetler, U.S. Pat. No. 4,643,341, discloses a sewing thimble having an inner barrel, a blade segment and an outer shell. The molded inner shell is semi-rigid and has a projecting lug for positioning the cutting edge of the blade segment. The outer shell is resilient or slightly deformable and is molded around and encases the inner barrel. The outer shell has a laterally projecting and thickened bulb area which covers the inner barrel lug beneath the cutting edge of the blade segment. A flap cut is formed in the bulb area so that a user may grip and pull a needle and thread by thumb pressure applied against the bulb area.

Callian, U.S. Pat. No. 5,765,731, discloses a thimble for use in quilting. sewing or the like to manipulate a needle including a flexible member and a shield member. The flexible member has four notches in spaced apart relation forming four tab portions positioned therebetween. The notches enable the tab portions to be bent about a finger of a person for conforming and fitting the thimble to the finger. One of the tab portions may be elongated to provide an elongated flap for fitting the thimble on a finger with a long fingernail. The flexible member is attached to or integrally formed with an adhesive material for securing the thimble to the finger of a person to prevent slippage of the thimble. The thimble further includes a shield member attached to the adhesive material of the flexible member for protecting the finger from contact with the needle. The shield member includes a dimple for seating the needle during use of the thimble and a curved surface for conforming to the finger of a person.

Boone et al., U.S. Pat. No. 5,803,322 discloses a stitch laying tool having a cylindrical thimble body having a center axis and a cylindrical side wall with opposite open ends to receive the tip of a stitcher's finger. An elongated stiff wire is secured to the side wall and extends substantially parallel to the center axis and has an outer end extending beyond one end of the cylindrical side wall. The outer end of the stiff wire has a short straight wire segment which forms an angle with respect to the stiff wire.

Miller, U.S. Pat. No. 6,726,068 B2, discloses a finger protective device constructed from elastomeric materials having a working surface covering the fleshy portion of a finger having sufficient strength and hardness to avoid penetration by a needle, yet being elastomeric to accommodate large variations in shape. The working surface may be interrupted by ribs or protrusions to prevent needle slippage. A compliant member surrounds the remainder of the finger and is softer in order to comply with the majority of finger shape variations. The thimble thus formed is designed to conform to the shape of a finger and remain adhered by frictional means to provide comfortable protection.

Jerome, U.S. Pat. No. 7,296,715 B1, discloses a thimble device for protecting fingers and thumb from a needle during a sewing operation wherein the thimble device comprises a top needle bearing surface having a dimple formed therein and two side surfaces with each side surface having an angled portion and a curved portion. The curved portions are sized and shaped for receiving a portion of the fingers when the thimble device is seated between the fingers. The thimble device further includes an angled front surface, an angled rear surface, and a curved bottom surface sized and shaped for receiving a portion of the thumb.

United States Patent Application Publication No. 2020/0102679 of Gupta discloses a thimble gripper with a flexible elastomeric strip with a thimble located at one end thereof and a gripping dome on the other end thereof. The thimble gripper is used to push a needle into material pressed by the slip resistant surface and to draw the needle from the material gripped between the friction enhancing surfaces of the dome and the elastomeric band. The thimble portion of the device has an elastomeric sleeve with a rigid cap.

Existing products with flexible sleeves tend to be difficult to fabricate and use. Consumers prefer relatively simple construction with a generally conventional appearance; however, an ability to accommodate a variety of finger and thumb (digit) sizes as well as prevent needle slippage on the thimble are highly sought-after features.

SUMMARY OF INVENTION

A thimble for sewing comprises: (a) a flexible tapered sleeve having a frustoconical shape and a pitch with a fluted sidewall having a "flower" pattern comprising a plurality of outwardly convex panels extending entirely around the sidewall and having a mounting end opposite an opening for inserting a digit of a user; and (b) a crown formed of hard plastic material affixed to the mounting portion of the sleeve, said crown having a cap with an upper textured planar surface and a ridged sidewall extending entirely around the crown, the ridged sidewall having a plurality of longitudinal ridges extending from a lower edge of the ridged sidewall of the crown to the cap.

Having ridges or hash marks running all around the top and side of the crown allows the user to use the top or the sides of the crown to push the needle into the fabric (some sewers/quilters prefer to use the side rather than the top to push the needle in). The ridged sidewall of the crown may have a tiered structure with a plurality of successively smaller diameter tiers as a distance from the lower edge of the sidewall increases towards the cap or may have a rectangular grid projecting from the sidewall of the crown as is discussed hereinafter. These features combined with the "flower" pattern in the rubber sleeve provides a great fit and multiple use, that is both a side and top functionality to push a needle into fabric.

The slip resistant surfaces of the thimble crown inhibit needle slippage, while the tapered, fluted flexible sleeve readily accommodates different size digits of users.

The flexible tapered sleeve preferably has a pitch of from 0.175 mm/mmL to 0.35 mm/mmL; suitably of from 0.175 mm/mmL to 0.25 mm/mmL between the opening of the sleeve and the mounting portion of the sleeve.

Further features and advantages will become apparent from the discussion which follows.

BRIEF DESCRIPTION OF DRAWINGS

The invention is described in detail below in connection with the accompanying drawings wherein like numerals designate similar parts and wherein.

DETAILED DESCRIPTION

Figure 1:
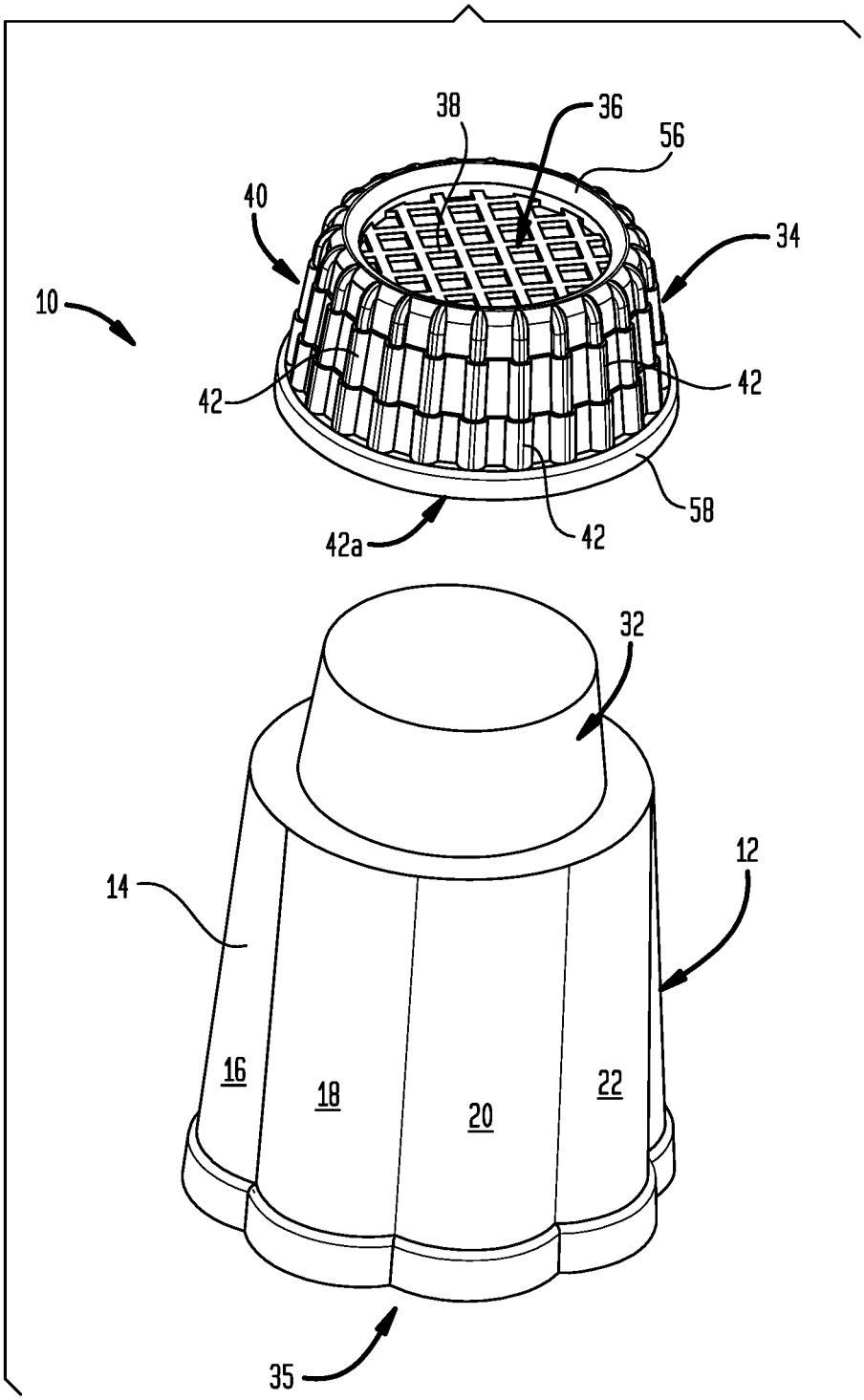
FIG. 1 is an exploded perspective view of a thimble of the invention characterized by a flexible tapered sleeve having a frustoconical shape and a pitch with a fluted sidewall comprising a plurality of outwardly convex panels, together with a hard plastic crown for mounting on the sleeve.
Figure 2:
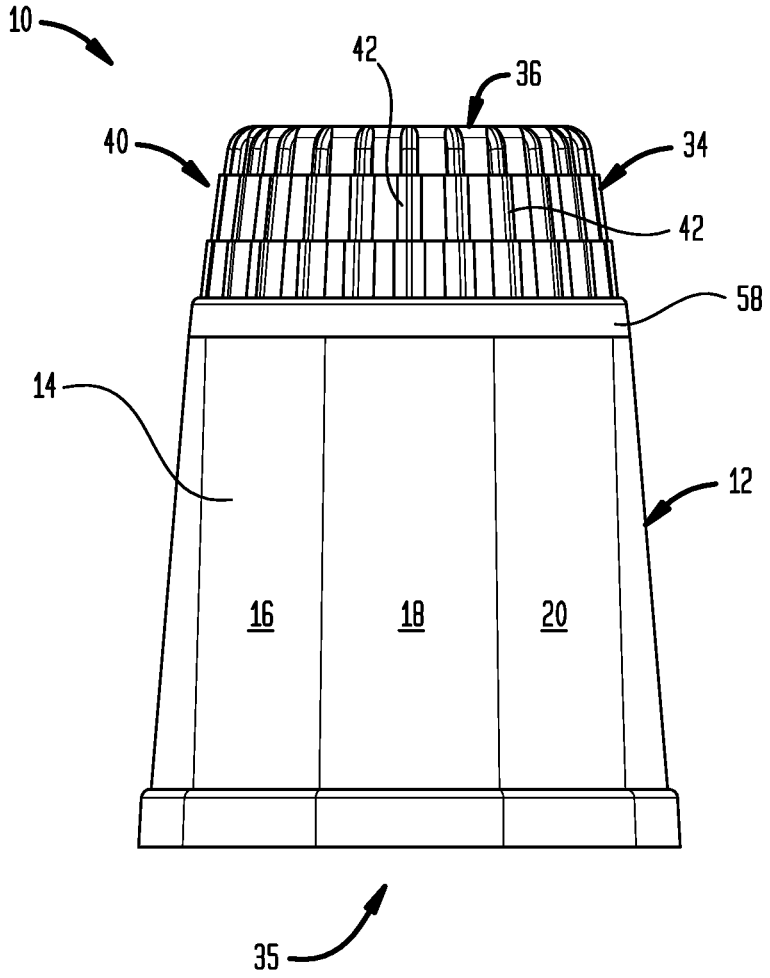
FIG. 2 is an assembled side view in elevation of a thimble of the invention wherein the flexible sleeve is affixed to the crown.
Figure 3:
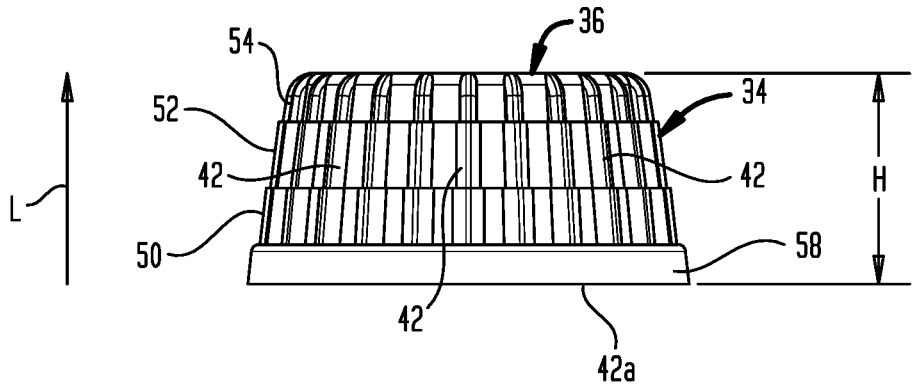
FIG. 3 is a side view in elevation of the crown of FIGS. 1 and 2.
Figure 4:
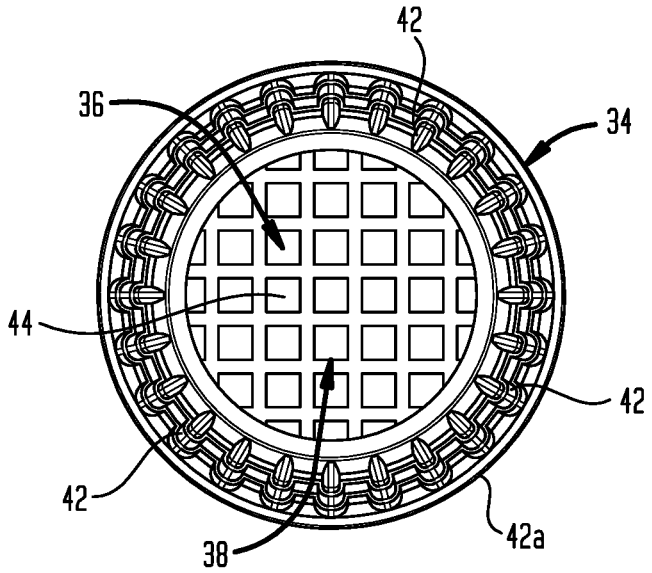
FIG. 4 is a top plan view of the crown of FIG. 3.
Figure 5:
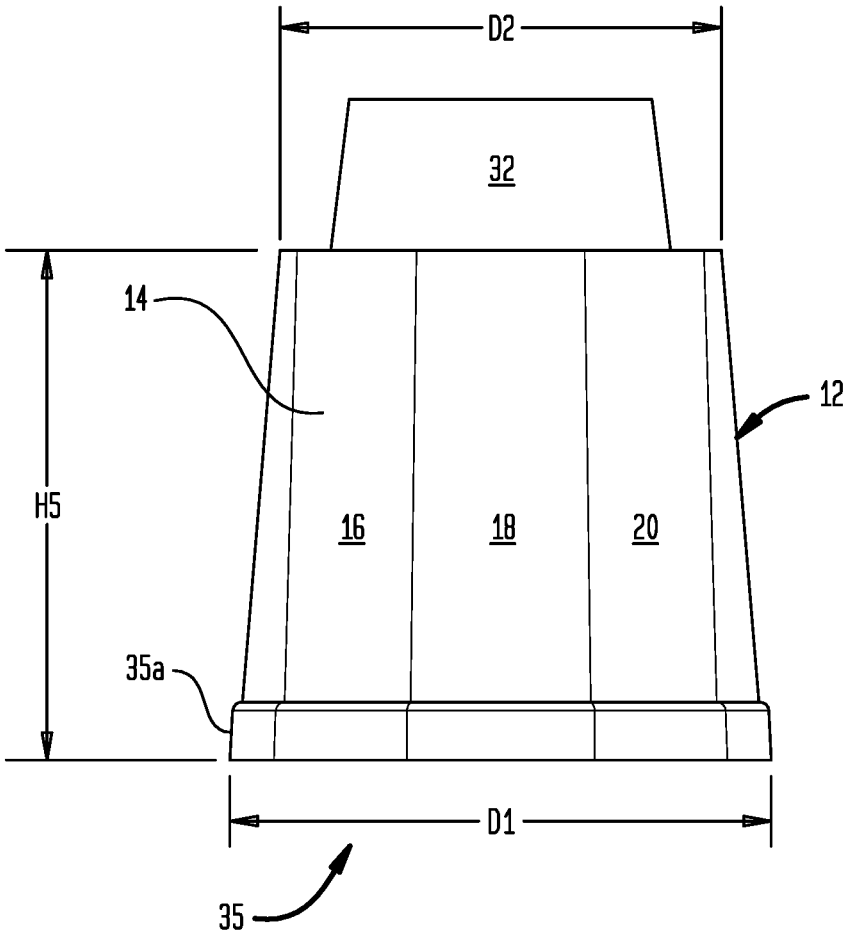
FIG. 5 is a side view in elevation of the flexible sleeve of FIGS. 1 and 2.
Figure 6:
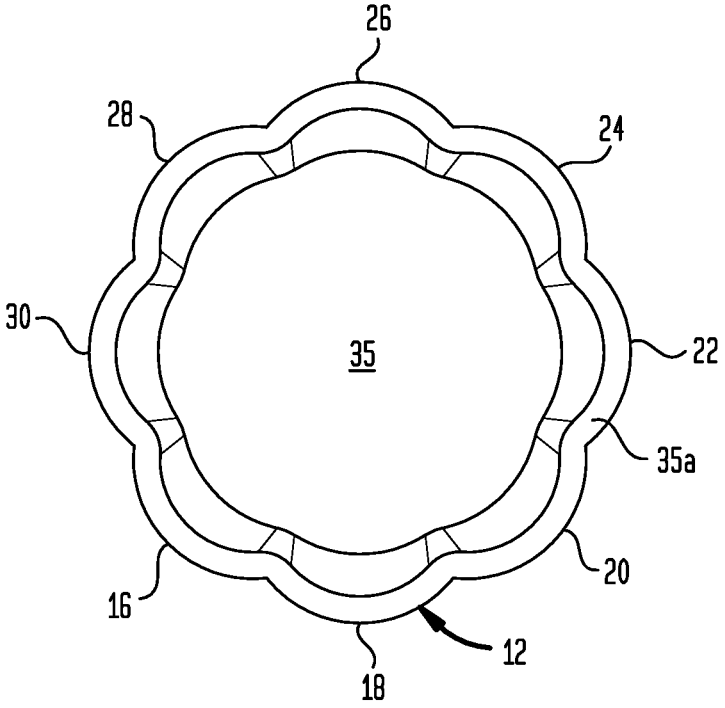
FIG. 6 is a bottom plan view of the flexible sleeve of FIG. 5.

Referring to FIGS. 1 to 6, there is illustrated a thimble 10 for sewing including: a flexible tapered sleeve 12 having a frustoconical shape and a pitch with a fluted sidewall 14 comprising a plurality (8) of outwardly convex panels 16, 18, 20, 22, 24, 26, 28 and 30 extending entirely around the sidewall and having a mounting end 32 opposite an opening 35 for inserting a digit of a user. Anywhere from 6 to 10 outwardly convex panels may be employed. Sleeve 12 is affixed to a crown 34 formed of hard plastic material affixed to the mounting end of the sleeve. The crown may be affixed to the sleeve with adhesive or the device may be produced by a two-shot molding process without adhesive if so desired.

Figure 7A:
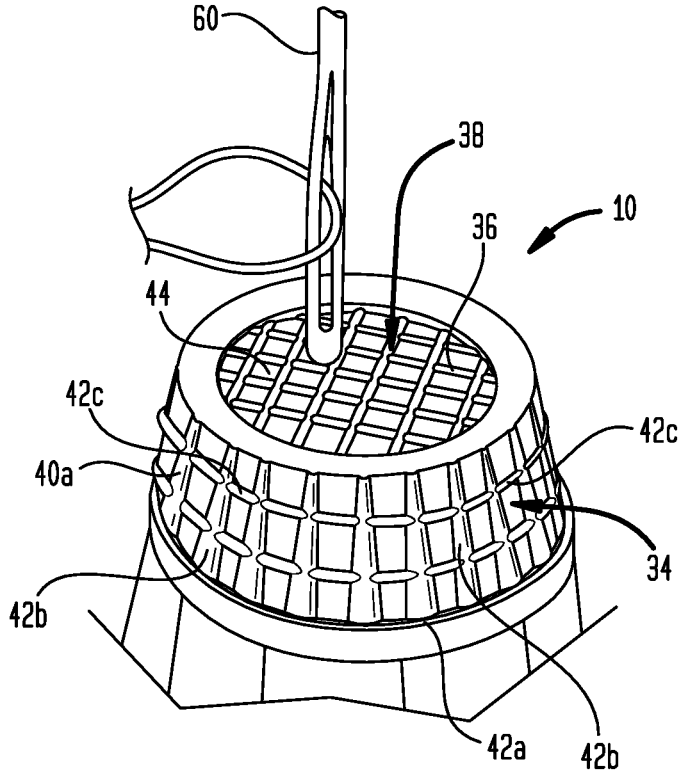
FIGS. 7A and 7B are enlarged schematic views of another embodiment of the invention showing use and construction of the thimble.
Figure 7B:
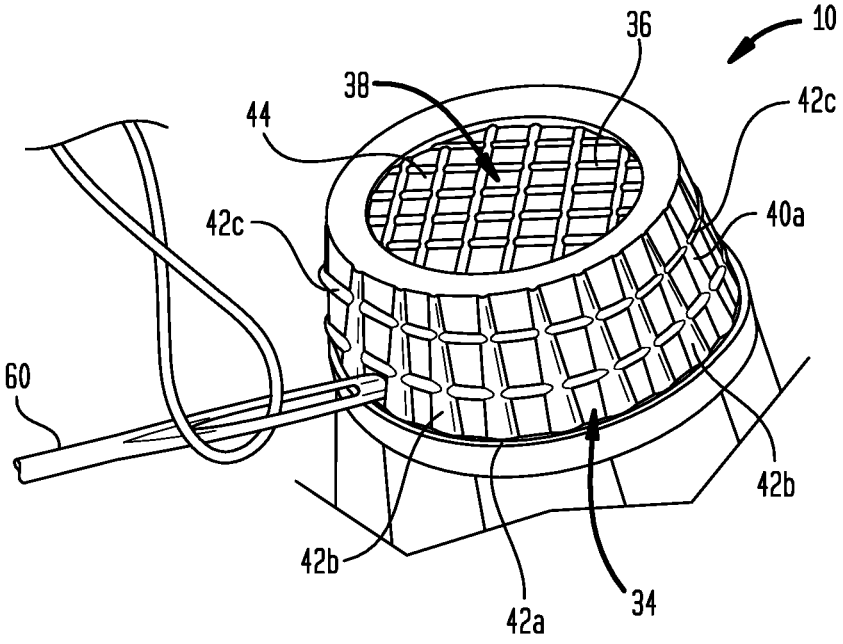

Crown 34 has a cap 36 with an upper textured planar surface 38 and a ridged sidewall 40 extending entirely around the crown. The ridged sidewall has a plurality of longitudinal ridges 42 extending from a lower edge 42*a* of the ridged sidewall of the crown to the cap. Textured surface 38 may be in the form of a rectangular grid 44 to prevent needle slippage across the surface when the flat surface of the thimble is used to push a needle into a fabric. Ridges 42 prevent needle slippage in a circumferential direction when sidewall 40 of the crown is used to advance the needle. The tiered structure of the crown sidewall also inhibits slippage of the needle in a direction toward the flexible sleeve. Alternatively, the sidewall of the crown may have a texture in the form of a rectangular grid (much like the upper cap surface) as shown in FIGS. 7A and 7B.

Ridged sidewall 40 has a tiered structure with a plurality (3) of successively smaller diameter tiers 50, 52, 54 as a distance L along the axis of the crown, from the lower edge 42*a* of the sidewall, increases towards the cap. In a preferred embodiment, sidewall 40 of crown 34 has a pitch slightly higher than fluted sidewall 14 of sleeve 12. The overall pitch of sidewall 40 of the crown is the lower diameter of the crown less the upper diameter of the crown divided by the height H of the crown. Each of tiers 50, 52 and 54 has a frustoconical shape in a preferred embodiment, as shown. Longitudinal ridges 42 extend entirely around the ridged sidewall 40 of the crown and are spaced a distance of from 0.5 to 2.5 mm from each other (that is, perpendicular distance between adjacent longitudinal ridges at ½H). Upper textured planar surface 38 of the cap may be in the form of a rectangular grid as shown. Crown 34 preferably has a unitary structure and is formed of a hard plastic by injection molding, for example. The plastic from which crown 34 is formed may suitably be polycarbonate or acrylonitrile-butadiene-styrene resin.

In order to further prevent needle slippage, cap 36 has an upwardly projecting lip 56 extending entirely around the textured planar surface of the cap as well as a lower lip 58 extending outwardly entirely around the ridged sidewall of the crown.

Generally mounting end 32 of the sleeve has a frustoconical shape as does the sleeve itself.

Convex panels 16, 18, 20, 22, 24, 26, 28 and 30 of the sidewall extend upwardly from opening 35 for inserting the digit of a user to the mounting portion. Generally, the flexible sleeve is made of rubber having a Durometer (Shore A) value of from 15 to 50. Suitably, the rubber is a silicone rubber.

In preferred embodiments the flexible sleeve has a pitch of from 0.175 mm/mmL to 0.35 mm/mmL; suitably from 0.175 mm/mmL to 0.25 mm/mmL. The pitch is defined as a diameter of the sleeve D1 at opening 35 less the diameter of the sleeve D2 at mounting end 32 divided by the height H5 of the mounting portion from opening 35. Preferably, opening 35 has a thickened ring 35*a* extending outwardly around the opening to provide reinforcement and the flexible sleeve has a unitary structure made by molding of an elastomeric resin.

FIGS. 7A and 7B are schematic views of an alternate construction of the inventive thimble wherein the sidewall of crown 34 has a textured surface in the form of a rectangular grid as shown, the other features are as described above. In FIGS. 7A and 7B crown 34 has a cap 36 with an upper textured planar surface 38 and a ridged sidewall 40*a* extending entirely around the crown. The ridged sidewall has a plurality of tapered longitudinal ridges 42*b* extending from a lower edge 42*a* of the ridged sidewall of the crown to the cap. Ridged sidewall 40*a* also has a plurality of circumferential ridges 42*c* which cooperate with longitudinal ridges 42*b* to provide a textured surface on the sidewall of the crown in the form of a rectangular grid.

Textured surface 38 is in the form of a rectangular grid 44 to engage butt-end of a needle 6 and prevent needle slippage across the surface when flat surface 38 of the thimble is used to push a needle 60 into a fabric as is shown schematically in FIG. 7A.

Ridges 42*b* prevent needle slippage in a circumferential direction when sidewall 40*a* of the crown is used to advance needle 60 as is shown in FIG. 7B. The rectangular texture of crown sidewall 40*a* also engages the butt-end of needle 60 to prevent slippage of needle 60 in a vertical direction with respect to the thimble by virtue of ridges 42*c* and lower edge 42*a* as is shown.

While the invention has been described in detail, modifications within the spirit and scope of the invention will be readily apparent to those of skill in the art. Such modifications are also to be considered as part of the present invention. In view of the foregoing discussion, relevant knowledge in the art and references discussed above in connection with the foregoing description including the Detailed Description and Background of the Invention, the disclosures of which are all incorporated herein by reference, further description is deemed unnecessary. In addition, it should be understood from the foregoing discussion that aspects of the invention and portions of various embodiments may be combined or interchanged either in whole or in part. Furthermore, those of ordinary skill in the art will appreciate that the foregoing description is by way of example only, and is not intended to limit the invention.

What is claimed is:

1. A thimble for sewing comprising:

(a) a flexible tapered sleeve having a frustoconical shape and a pitch with a fluted sidewall comprising a plurality of outwardly convex panels extending entirely around the sidewall and having a mounting end opposite an opening for inserting a digit of a user; and (b) a crown formed of hard plastic material affixed to the mounting portion of the sleeve, said crown having a cap with an upper textured planar surface and a ridged sidewall extending entirely around the crown, the ridged sidewall having a plurality of longitudinal ridges extending from a lower edge of the ridged sidewall of the crown to the cap; wherein the ridged sidewall of the crown has a plurality of circumferential ridges which cooperate with the longitudinal ridges to provide a textured surface on the sidewall of the crown in the form of a rectangular grid.

2. The thimble according to claim 1, wherein the ridged sidewall of the crown has a tiered structure with a plurality of successively smaller diameter tiers as a distance from the lower edge of the sidewall increases towards the cap.

3. The thimble according to claim 2, wherein the ridged sidewall has three tiers, as well as an overall pitch higher than the pitch of the sidewall.

4. The thimble according to claim 2, wherein each tier has a frustoconical shape.

5. The thimble according to claim 1, wherein the longitudinal ridges extending entirely around the ridged sidewall of the crown and are spaced a distance of from 0.5 to 2.5 mm from each other.

6. The thimble according to claim 1, wherein the upper textured planar surface of the cap is in the form of a rectangular grid.

7. The thimble according to claim 1, wherein the crown has a unitary structure and is formed of a hard plastic.

8. The thimble according to claim 7, wherein the hard plastic is selected from polycarbonate and acrylonitrile-butadiene-styrene resins.

9. The thimble according to claim 1, wherein the cap has an upwardly projecting lip extending entirely around the textured planar surface of the cap.

10. The thimble according to claim 1, wherein the ridged sidewall of the crown has a lower lip extending outwardly entirely around the ridged sidewall of the crown.

11. The thimble according to claim 1, wherein the mounting end of the sleeve has a frustoconical shape.

12. The thimble according to claim 1, wherein the outwardly convex panels of the fluted sidewall extend upwardly from the opening for inserting the digit of a user to the mounting portion.

13. The thimble according to claim 1, wherein the flexible tapered sleeve is made of rubber having a Durometer (Shore A) value of from 15 to 50.

14. The thimble according to claim 13, wherein the rubber is a silicone rubber.

15. The thimble according to claim 1, wherein the flexible tapered sleeve has a pitch of from 0.175 mm/mmL to 0.35 mm/mmL.

16. The thimble according to claim 1, wherein the opening for inserting a digit of the user is reinforced with a thickened ring extending outwardly around the opening.

17. The thimble according to claim 1, wherein the flexible tapered sleeve has a unitary structure.

18. A thimble for sewing consisting of:

(a) a flexible tapered sleeve having a frustoconical shape and a pitch with a fluted sidewall comprising a plurality of outwardly convex panels extending entirely around the sidewall and having a mounting end opposite an opening for inserting a digit of a user, said sleeve also having a pitch of from 0.175 mm/mmL to 0.35 mm/mmL; and (b) a crown formed of hard plastic material affixed to the mounting portion of the sleeve, said crown having a cap with an upper textured planar surface and a ridged sidewall extending entirely around the crown, the ridged sidewall having a plurality of longitudinal ridges extending from a lower edge of the ridged sidewall of the crown to the cap; wherein the ridged sidewall of the crown has a plurality of circumferential ridges which cooperate with the longitudinal ridges to provide a textured surface on the sidewall of the crown in the form of a rectangular grid.

19. The thimble according to claim 18, wherein the sleeve is made of a silicone rubber.

20. A thimble for sewing comprising:

(a) a flexible tapered sleeve having a frustoconical shape and a pitch with a fluted sidewall comprising a plurality of outwardly convex panels extending entirely around the sidewall and having a mounting end opposite an opening for inserting a digit of a user; and (b) a crown formed of hard plastic material affixed to the mounting portion of the sleeve, said crown having a cap with an upper textured planar surface and a ridged sidewall extending entirely around the crown, the ridged sidewall having a plurality of longitudinal ridges extending from a lower edge of the ridged sidewall of the crown to the cap; wherein the ridged sidewall of the crown has a lower lip extending outwardly entirely around the ridged sidewall of the crown.

* * * * *